US011969778B1

(12) United States Patent
Matthäß

(10) Patent No.: US 11,969,778 B1
(45) Date of Patent: Apr. 30, 2024

(54) METHOD FOR PROVIDING SHEET METAL PIECES FOR DRAWING INTO A SHEET METAL BENDING MACHINE, AND COMBINATION OF A DEVICE FOR PROVIDING SHEET METAL PIECES FOR DRAWING INTO A SHEET METAL BENDING MACHINE WITH THE SHEET METAL BENDING MACHINE AND WITH A SIDE DRAWING-IN DEVICE

(71) Applicant: Variobend-ASCO GmbH, Bischofswiesen (DE)

(72) Inventor: Sylvio Matthäß, Bayerisch Gmain (DE)

(73) Assignee: Variobend-ASCO GmbH, Bischofswiesen (DE)

( * ) Notice: Subject to any disclaimer, the term of this patent is extended or adjusted under 35 U.S.C. 154(b) by 0 days.

(21) Appl. No.: 18/465,674

(22) Filed: Sep. 12, 2023

(30) Foreign Application Priority Data

Oct. 19, 2022 (EP) ..... 22202600

(51) Int. Cl.
*B21D 43/02* (2006.01)
*B21D 43/10* (2006.01)

(52) U.S. Cl.
CPC ..... *B21D 43/02* (2013.01); *B21D 43/10* (2013.01)

(58) Field of Classification Search
CPC ..... B21D 5/002; B21D 5/004; B21D 5/0281; B21D 43/10; B21D 43/11; B21D 43/12; B21D 43/02; G05B 2219/45142
USPC ..... 72/420
See application file for complete search history.

(56) References Cited

U.S. PATENT DOCUMENTS 5,950,484 A * 9/1999 Kutschker ..... B21D 5/042 72/19.4
7,201,032 B2 * 4/2007 Pfitzner ..... B21D 43/105 382/152
7,210,328 B2 5/2007 Strasser
7,444,850 B2 * 11/2008 Bauersachs ..... B21J 13/10 72/422
8,074,484 B2 * 12/2011 Denkmeier ..... B21D 5/0281 72/422

(Continued)

FOREIGN PATENT DOCUMENTS

DE 19809184 A1 10/1998
DE 102004051994 A1 4/2006

(Continued)

OTHER PUBLICATIONS

Translation WO 2006/045276A1, Ulrich et al. May 2006.*

(Continued)

*Primary Examiner* — Edward T Tolan
(74) *Attorney, Agent, or Firm* — Kilpatrick Townsend & Stockton LLP

(57) ABSTRACT

Method for providing sheet metal pieces, which are arranged at least in part side-by-side on a planar deposition surface, for drawing into a sheet metal bending machine by means of a side drawing-in device which is arranged on the sheet metal bending machine, wherein the side drawing-in device includes a pick-up device that is movable into the sheet metal bending machine and is intended for picking up a sheet metal piece to be drawn into the sheet metal bending machine at a pick-up position above the deposition surface that can be approached by the pick-up device.

16 Claims, 12 Drawing Sheets

(56) References Cited

U.S. PATENT DOCUMENTS

Figure 1:
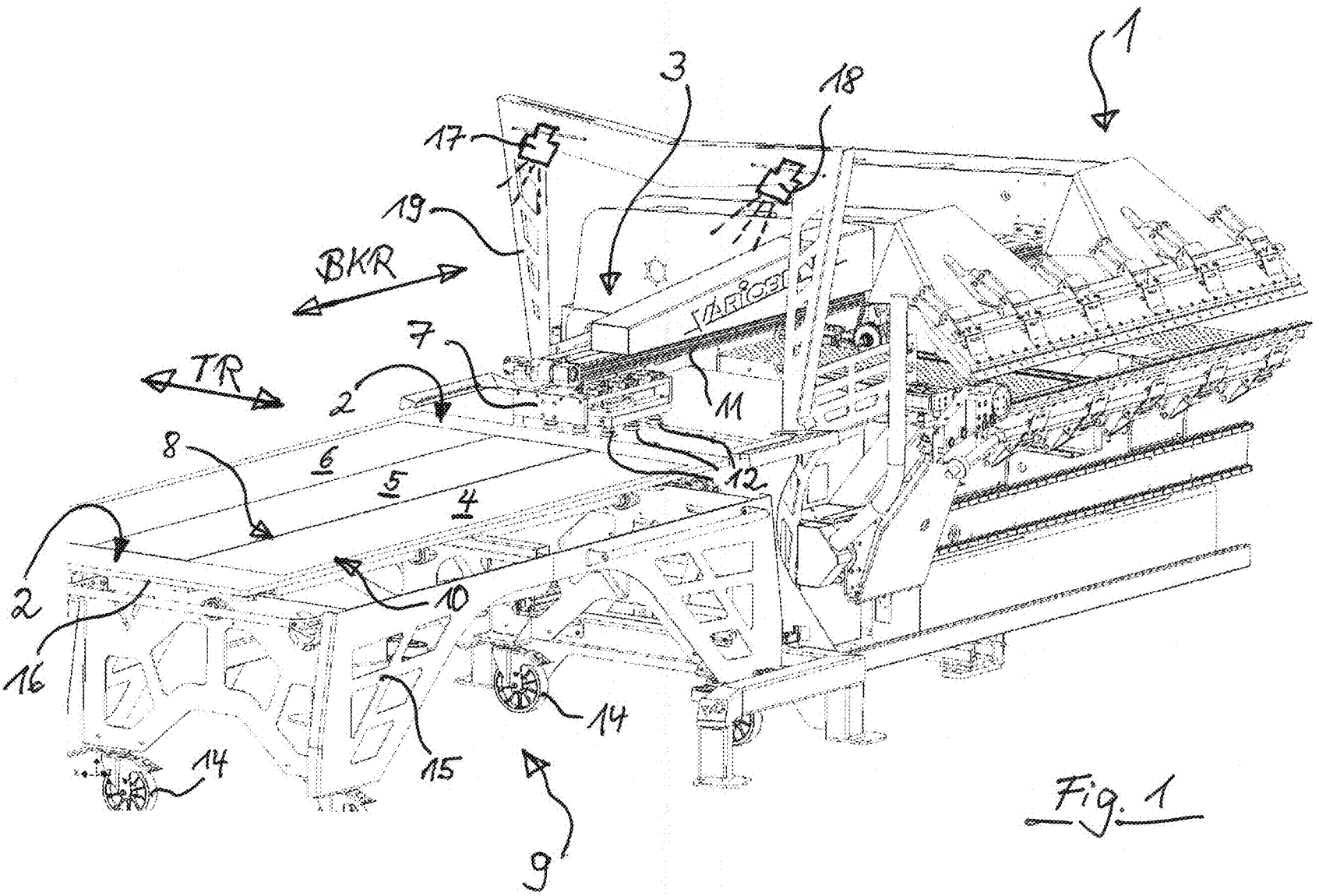

| | | | | |
|---|---|---|---|---|
| 2006/0179913 | A1* | 8/2006 | Strasser | B21D 5/02 72/420 |
| 2019/0143391 | A1* | 5/2019 | Walti | B21D 43/24 414/783 |

FOREIGN PATENT DOCUMENTS

| | | | | |
|---|---|---|---|---|
| EP | 3778048 | A1 | 2/2021 | |
| WO | 2006/045276 | A1 * | 5/2006 | B21D 43/003 |

OTHER PUBLICATIONS

"TRUMPF Bending: Automated Loading and Unloading of the TruBend Center 7030", Trumpftube, retrieved from https://www.youtube.com/watch?v=XQXqWKy3m6c&ab_channel=TRUMPFtube, Mar. 18, 2019 and printed on Mar. 27, 2023, 2 pages.

European Application No. EP22202600.7, "Extended European Search Report", dated Apr. 4, 2023, 11 pages.

* cited by examiner

METHOD FOR PROVIDING SHEET METAL PIECES FOR DRAWING INTO A SHEET METAL BENDING MACHINE, AND COMBINATION OF A DEVICE FOR PROVIDING SHEET METAL PIECES FOR DRAWING INTO A SHEET METAL BENDING MACHINE WITH THE SHEET METAL BENDING MACHINE AND WITH A SIDE DRAWING-IN DEVICE

CROSS REFERENCE TO RELATED APPLICATION

This application claims priority to European Patent Application No. 22202600.7, filed in Europe on Oct. 19, 2022, the entire contents of which are hereby incorporated herein by this reference.

FIELD OF APPLICATION

The present invention relates to a method for providing sheet metal pieces for drawing into a sheet metal bending machine, and a combination of a device for providing sheet metal pieces for drawing into a sheet metal bending machine with the sheet metal bending machine and with a side drawing-in device for drawing the sheet metal pieces into the sheet metal bending machine. The sheet metal bending machine is preferably a long folding machine which can be designed as a single bending machine for bending in just one single bending direction, or as a double bending machine for selectively bending about two opposing bending directions.

TECHNICAL BACKGROUND

EP 3 778 048 A1 discloses a sheet metal bending machine in the form of a long folding machine that is designed as a double bending machine. It comprises what is known as a side drawing-in device, which grasps a sheet metal piece 5, to be drawn into the sheet metal bending machine, by means of suction caps 51, and draws it laterally into the sheet metal bending machine. The suction caps 51 cannot move in the horizontal depth direction of the sheet metal bending machine, transversely to the bending edge formed by the lower cheek 21 or upper cheek 23.

In the case of the known sheet metal bending machine, the sheet metal piece 5 to be drawn in is provided on a stationary table surface 80 of a transfer table. In order to arrange the sheet metal piece 5 at the correct position for the suction caps 51, in the horizontal depth direction of the sheet metal bending machine, said sheet metal piece is pressed against stops 12 acting in the above-mentioned depth direction.

The sheet metal pieces to be processed are routinely cut into strip shapes, by means of conventional longitudinal and transverse dividing devices, from a sheet metal web previously wound onto a coil. The longitudinal and transverse dividing device lays the cut sheet metal strips side-by-side, in parallel with one another, on the table surface of a transfer table. Said transfer table can be moved towards the sheet metal bending machine and be coupled thereto in such a way that its table surface is stationary relative to the bending machine.

In order to be able, in this case, to draw all the sheet metal strips, lying side-by-side on the table surface, into the sheet metal bending machine, the sheet metal strips are stacked one above the other by hand. The stack, consisting of a plurality of sheet metal strips, can then be pressed against stops 12 of the type mentioned in EP 3 778 048 A1, for example, in order to ensure that the suction caps 51 can always grasp the upper most sheet metal strip of the stack, in each case, at the same point of the table surface 80.

The stacking of the sheet metal pieces, to be carried out by hand in the prior art, requires manpower and is in particular associated with a significant expenditure of time.

ILLUSTRATION OF THE INVENTION a) Technical Problem

The problem addressed by the present invention is therefore that of providing a method for providing sheet metal pieces for drawing into a sheet metal bending machine, and a combination of a device for providing sheet metal pieces for drawing into a sheet metal bending machine with the sheet metal bending machine and with a side drawing-in device, by means of which sheet metal pieces, which have been cut to size by a longitudinal and transverse dividing device and laid side-by-side in parallel, can be provided, for drawing into a sheet metal bending machine, in as time-saving a manner as possible.

b) Solution to the Problem

This problem is solved by a method having the features of claim 1 and/or by a combination having the features of claim 4. Further embodiments of the present invention can be found in the dependent claims.

According to the invention, a method for providing preferably strip-shaped sheet metal pieces for drawing into a sheet metal bending machine by means of a side drawing-in device is proposed. In this case, the sheet metal pieces are arranged at least in part side-by-side on a planar deposition surface. In this connect, "arranged in part side-by-side" means that not only a single layer of sheet metal pieces can be arranged side-by-side, but rather instead a plurality of stacks, consisting of a plurality of sheet metal pieces in each case, can be arranged side-by-side. For example, it is conceivable for there to be nine sheet metal pieces on the deposition surface, it being possible for said pieces to lie on the deposition surface in a total of three stacks of three sheet metal pieces each. In this case, only some of the total of nine sheet metal pieces are located side-by-side on the deposition surface.

The side drawing-in device is arranged on the sheet metal bending machine, preferably on the upper part of the sheet metal bending machine which is pivotable about a horizontal axis. The side drawing-in device comprises a pick-up device that is movable in the sheet metal bending machine, for example in the form of one or more suction caps, which serves to pick up a sheet metal piece, to be drawn into the sheet metal bending machine, at a pick-up position which can be approached preferably horizontally by the pick-up device and which is preferably located vertically above the deposition surface.

The method according to the invention comprises the following steps:

a) detecting, by means of a sensor, the position of the sheet metal piece, to be drawn into the sheet metal bending machine, on the deposition surface, preferably relative to a reference point, a reference line or a reference edge of the deposition surface, b) electronically comparing the position detected in step a) with the pick-up position that can be approached by the pick-up device, and c) moving, in a motorised manner, the deposition surface, together with the sheet metal piece that is located thereon and is to be drawn in, relative to the sheet metal bending machine, such that the sheet metal piece comes to rest, at least in part, under the pick-up position that can be approached by the pick-up device, and can be picked up there by the pick-up device, when the sheet metal piece to be drawn is not yet located under the pick-up position in a manner in which it can be picked up.

The pick-up device preferably grabs the sheet metal piece, to be drawn in, vertically from above. Accordingly, the pick-up position preferably denotes a position in a horizontal plane above the deposition surface, from which the pick-up device can be moved vertically downwards towards the sheet metal piece.

With knowledge of the position of the sheet metal piece, to be drawn in, on the deposition surface, it is possible for an electronic machine controller to move or displace the deposition surface relative to the sheet metal bending machine or relative to the side drawing-in device in exactly such a way that a portion of the sheet metal piece to be drawn in is located exactly under the pick-up position of the pick-up device. Manual stacking of sheet metal pieces previously lying side-by-side on the deposition surface is unnecessary. Stops protruding upwards from the deposition surface are also no longer necessary. The respective movement or displacement of the deposition surface is carried out by means of the electronic machine controller in a fully automated manner, and accordingly in a time-saving manner.

Advantageously, the detection of the position according to step a) can be carried out by optical detection of reference edges of the sheet metal piece to be drawn in. In this case, the information relating to the position of the reference edges relative to a reference point, a reference line or a reference edge is provided to the electronic machine controller by means of wired or wireless data transmission. Preferably one or more cameras are used for optically detecting the reference edges.

In each case an individual job identification, for example in the form of a printed barcode or a printed QR code, can be applied to the sheet metal pieces to be processed. The job identification is associated with individual information for specifying a bending task to be carried out. Preferably, said job identification is detected optically when a sheet metal piece is lying on the deposition surface, and a signal representing the job identification is transmitted in a wired or wireless manner to the machine controller of the sheet metal bending machine. The machine controller can then cause the bending task to be carried out, after the sheet metal piece has been drawn in, by the sheet metal bending machine according to the individual information for specifying the bending task to be carried out.

The sequence in which the sheet metal pieces are picked up from the deposition surface and drawn into the sheet metal bending machine can be specified by programming of the electronic machine controller. For example, it is conceivable that the sheet metal piece that is located, on the deposition surface, closest to the pick-up position of the pick-up device is always picked up from the deposition surface. However, it is also conceivable that information relating to the sequence of picking up and drawing in of the sheet metal pieces is stored in the job identifications of a plurality of sheet metal pieces lying side-by-side on the deposition surface. The electronic machine controller, after reading out the job identifications, then selects the sequence that may be specified thereby.

According to the invention, a combination of a device for providing sheet metal pieces for drawing into a sheet metal bending machine with the sheet metal bending machine itself and with the side drawing-in device for laterally drawing a sheet metal piece into the sheet metal bending machine is also proposed. In this case, the side drawing-in device is arranged on the sheet metal bending machine, preferably on the upper part thereof.

The device can preferably be releasably coupled to the sheet metal bending machine and comprises a planar deposition surface on which the sheet metal pieces to be processed can be kept available at least in part side-by-side. The device can for example be a providing table that bears the deposition surface and is displaceable relative to the sheet metal bending machine by means of a conventional longitudinal and transverse dividing device and can preferably be releasably coupled to said sheet metal bending machine in such a way that a defined relative position of a reference point, a reference line or a reference edge of the deposition surface relative to the pick-up position is maintained.

The side drawing-in device comprises a pick-up device that is movable in the sheet metal bending machine and is intended for picking up a sheet metal piece, to be drawn into the sheet metal bending machine, at a pick-up position above the deposition surface, which can be approached by the pick-up device.

According to the invention a motor drive device is provided, by means of which the deposition surface is movable relative to the sheet metal bending machine or relative to the side drawing-in device or relative to the pick-up device in the state where the device is coupled to the sheet metal bending machine. In this case, the motor drive device can move the deposition surface relative to the device, which is fixed in a defined manner relative to the sheet metal bending machine. Alternatively, it is conceivable that the coupling of the device to the sheet metal bending machine is designed such that the entire device, including the deposition surface, can be displaced relative to the sheet metal bending machine, by means of the motor drive device, in the state coupled to the sheet metal bending machine.

A sensor device serves to detect the position of the sheet metal piece, to be drawn into the sheet metal bending machine, on the deposition surface, preferably relative to a reference point, a reference line or a reference edge of the deposition surface.

Furthermore, a comparator device is provided, which serves to compare the position detected by means of the sensor device with the pick-up position that can be approached by the pick-up device. As mentioned above, the pick-up position that can be approached is preferably located in a horizontal plane above the deposition surface.

According to the invention, an electronic machine controller is also provided, which is designed to cause the motor drive device to move the deposition surface, together with the sheet metal piece that is located thereon and is to be drawn in, relative to the sheet metal bending machine, in the state when the device is coupled to the sheet metal bending machine. This movement takes place in such a way that the sheet metal piece comes to rest at least in part vertically under the pick-up position that can be approached by the pick-up device, in order to be picked up there by the pick-up device.

The machine controller does not cause the above-mentioned movement of the deposition surface if the comparator device has previously determined that the sheet metal piece to be drawn in is already located under the predefined pick-up position of the pick-up device. In this case, the sheet metal piece can be picked up, for the purpose of being drawn into the sheet metal bending machine, directly, without prior movement of the deposition surface relative to the pick-up position.

The comparator device does not necessarily have to be a device separate from the machine controller. Within the context of the present invention, the comparator device can be designed as a hardware and/or software component of the electronic machine controller.

The sensor device of the combination according to the invention can be an optical sensor device for optically detecting reference edges of the sheet metal piece to be drawn in. The positions thereof are preferably detected relative to a reference point, a reference line or a reference edge of the deposition surface. The reference point, the reference line or the reference edge define a reference position, stored in the machine controller, of the deposition surface relative to the pick-up position, in a particular reference position, also stored in the machine controller, of the deposition surface relative to the pick-up position.

The sensor device is preferably formed by one or more cameras.

A job identification applied to the sheet metal piece to be drawn in, for example in the form of a printed barcode or a printed QR code, can be detectable by means of the sensor device, which identification is associated with individual information for specifying a bending task to be carried out. The electronic machine controller is designed such that, after receiving a signal representing the individual job identification, it causes the sheet metal bending machine to carry out the bending task, after the sheet metal piece has been drawn in, according to the individual information for specifying the bending task to be carried out. The individual information for specifying the bending task to be carried out can for example be the number and position of the bends to be performed on the sheet metal piece and the associated bending angle in each case.

c) Embodiment

Figure 2:
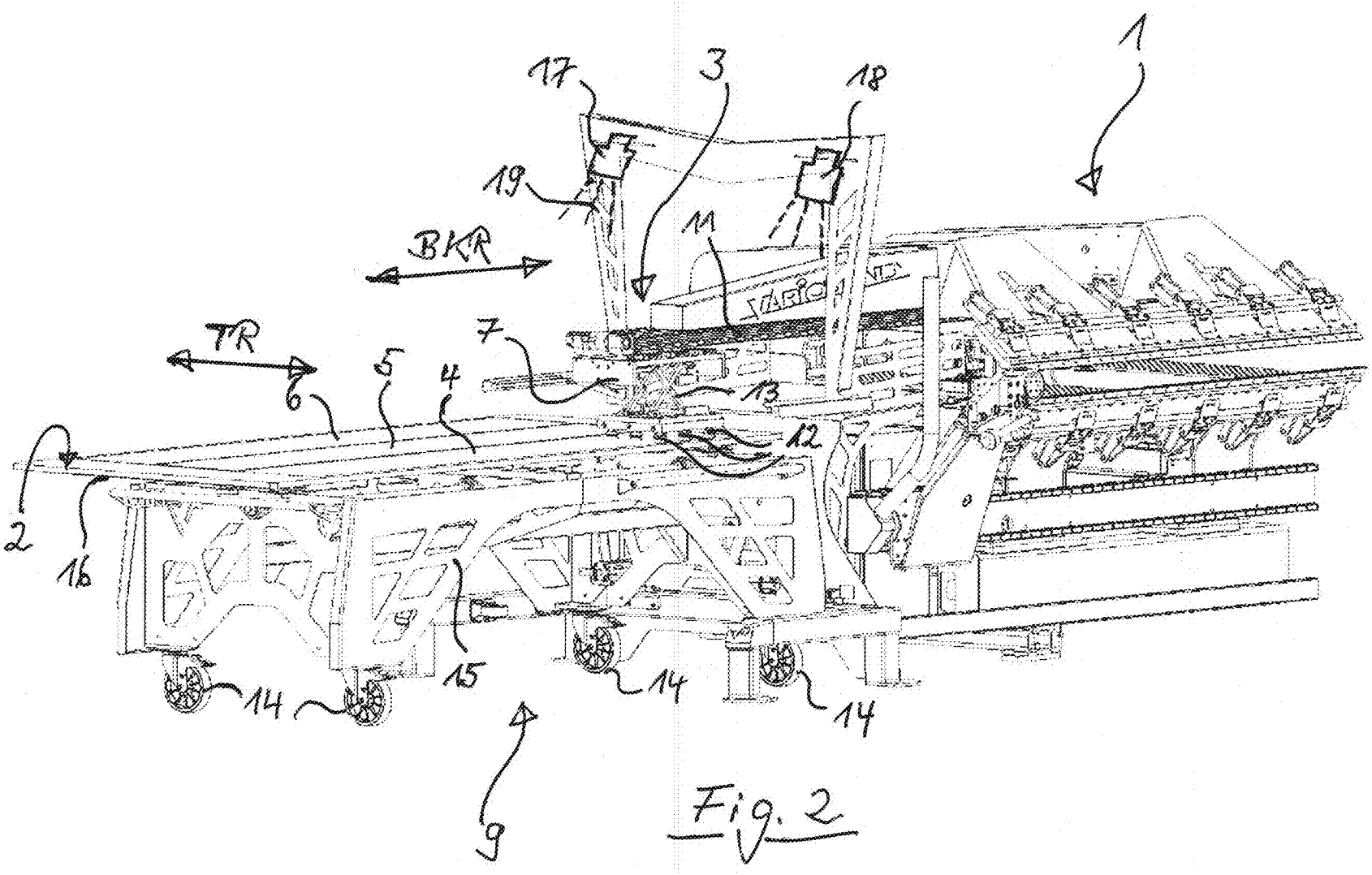
Figure 3:
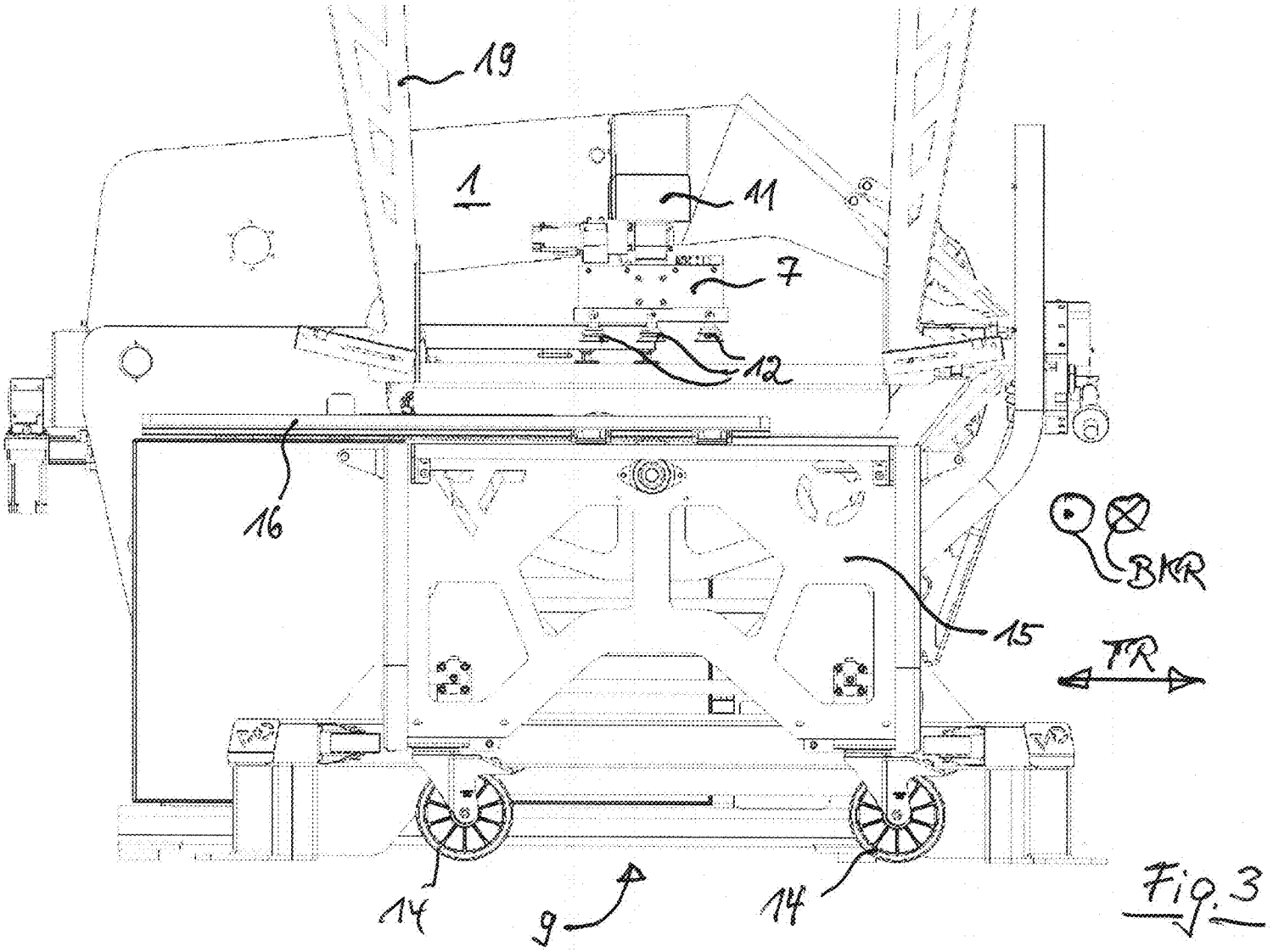
Figure 4:
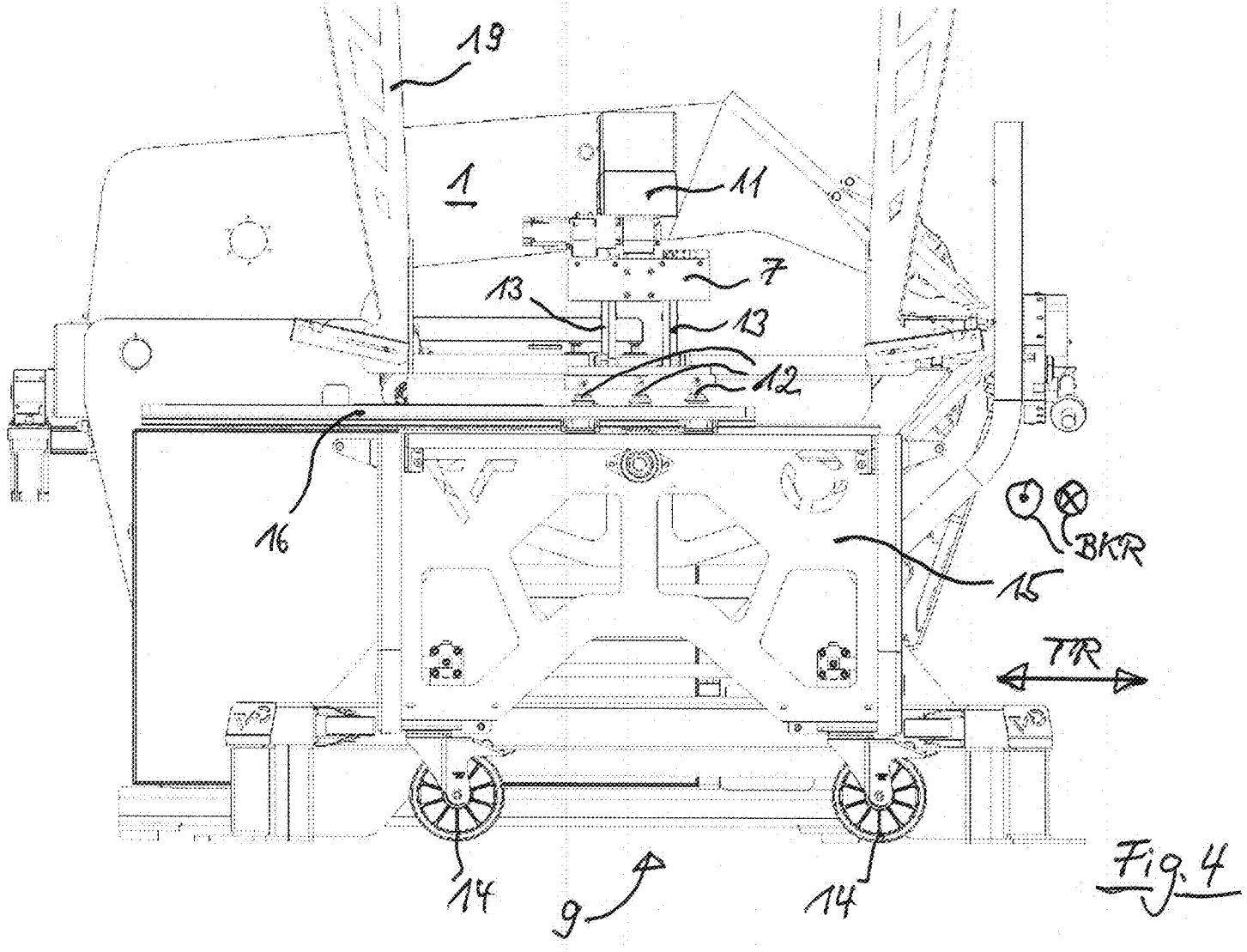
Figure 5:
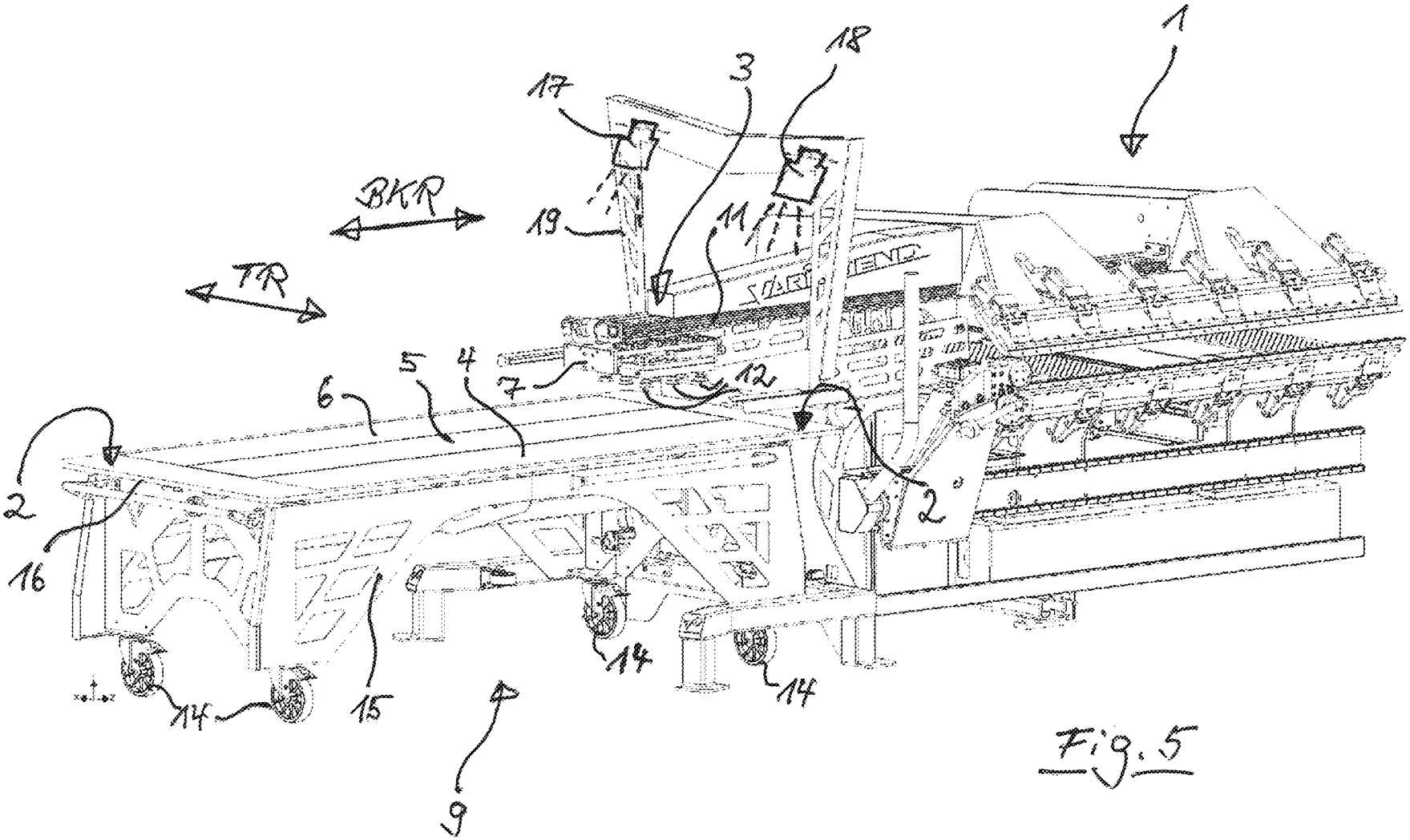
Figure 6:
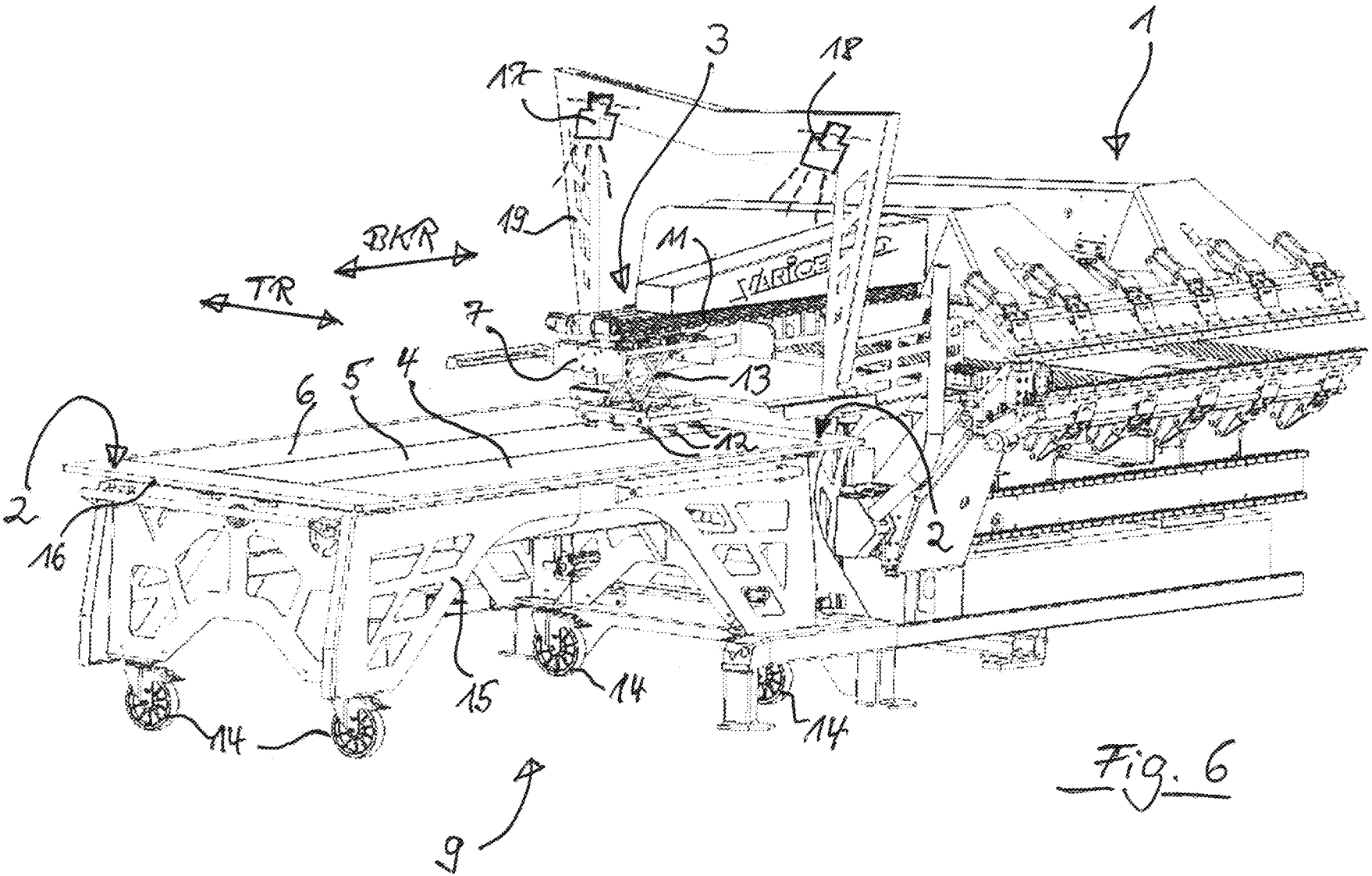
Figure 7:
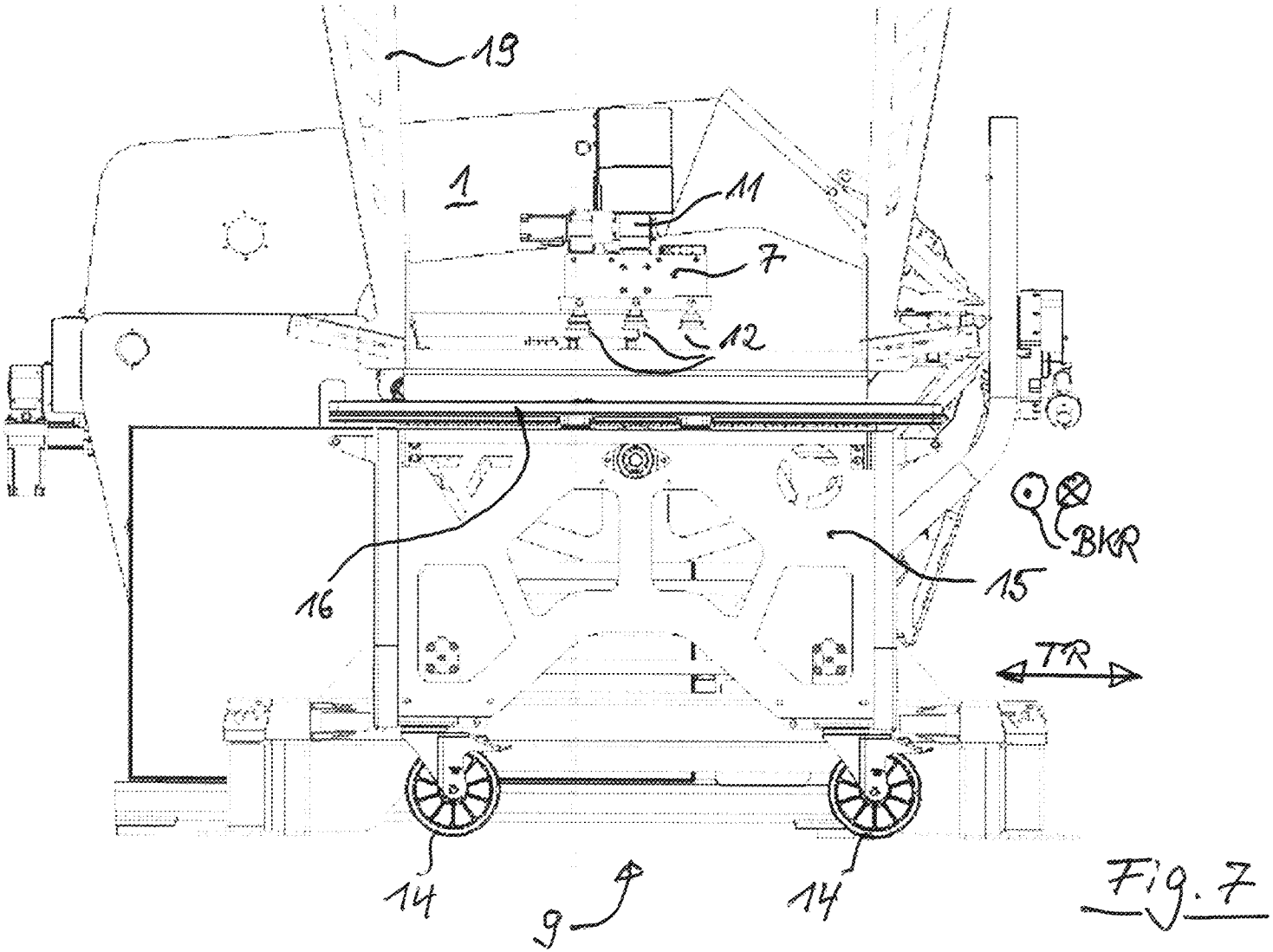
Figure 8:
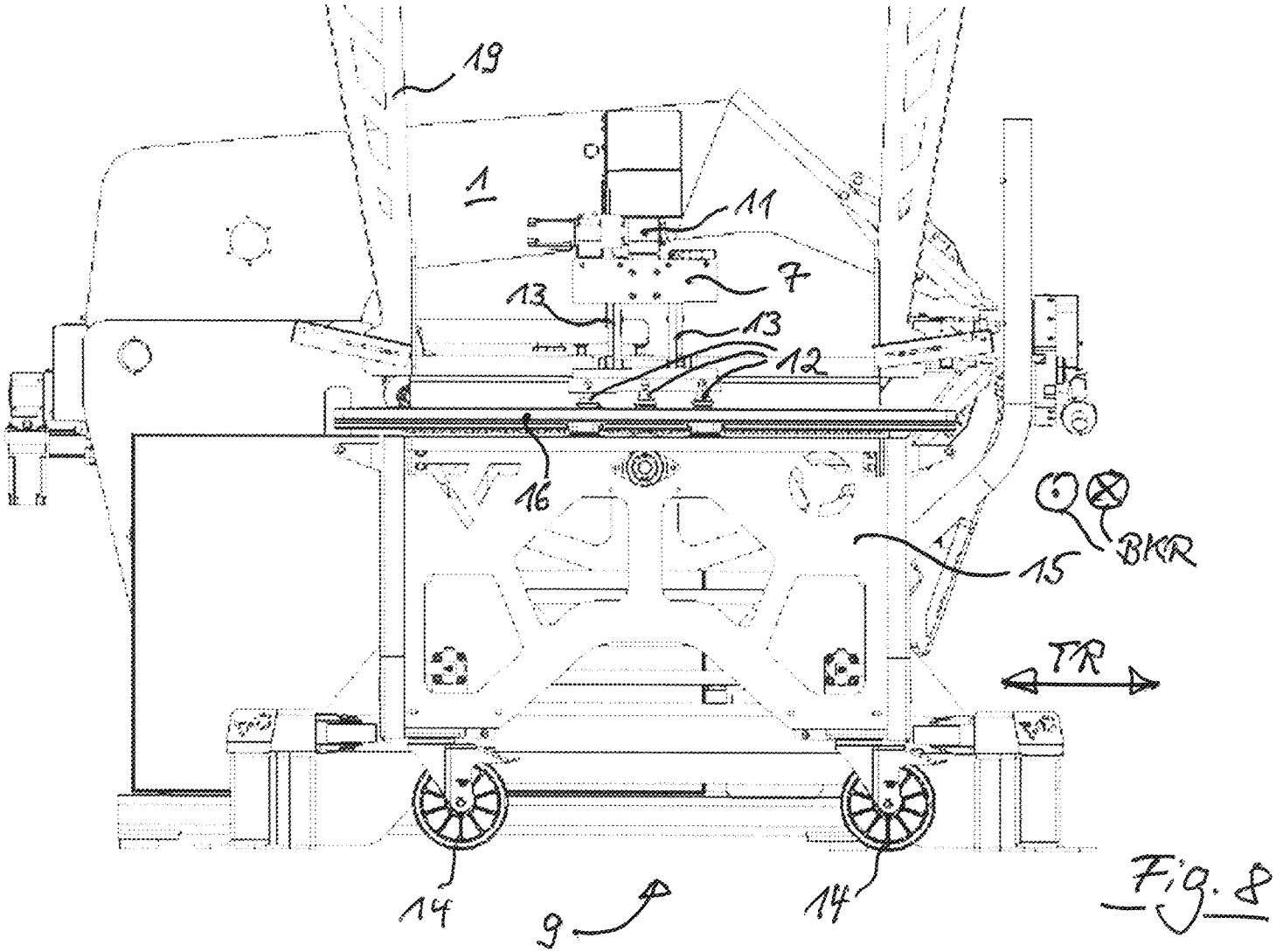
Figure 9:
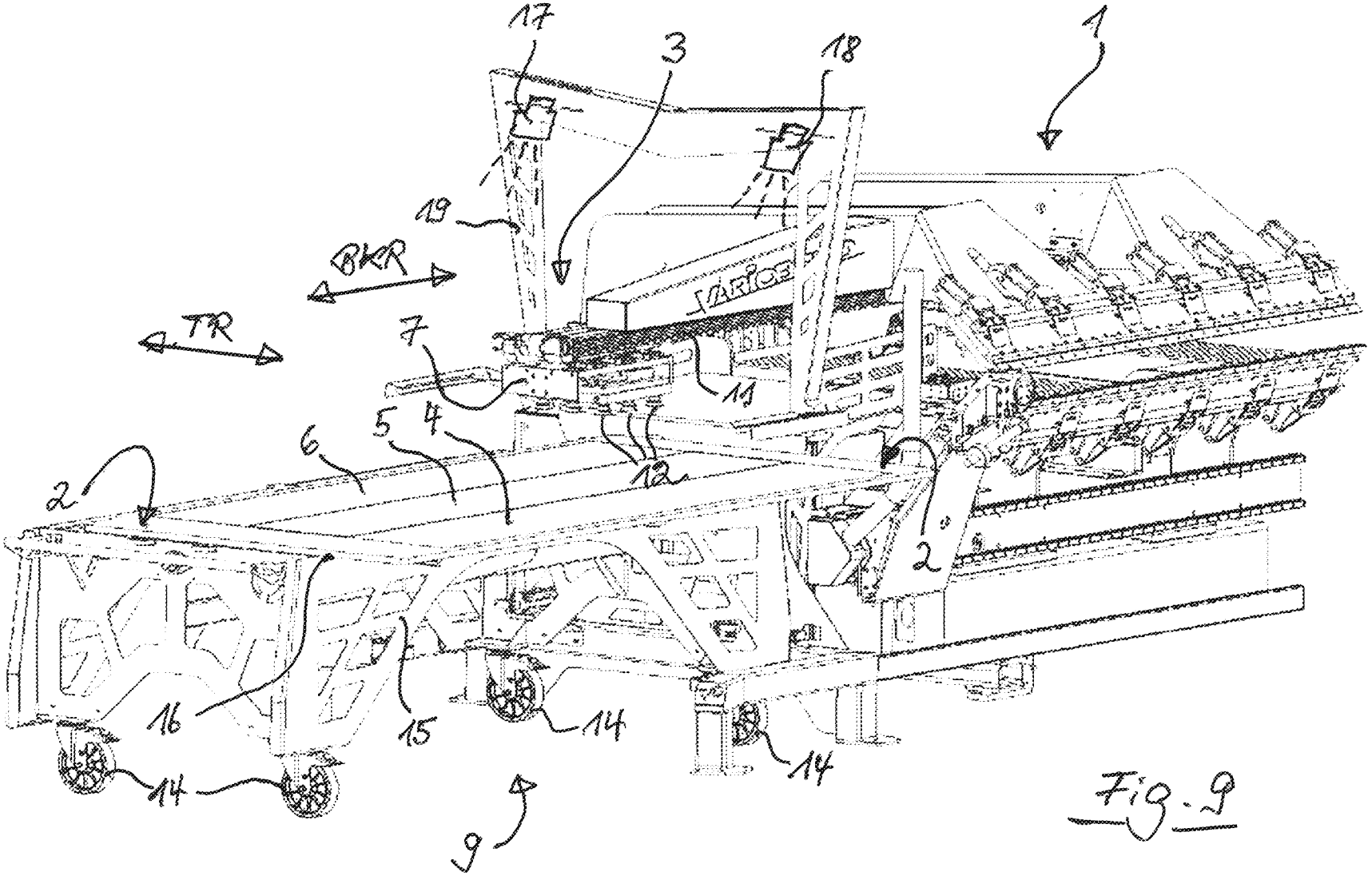
Figure 10:
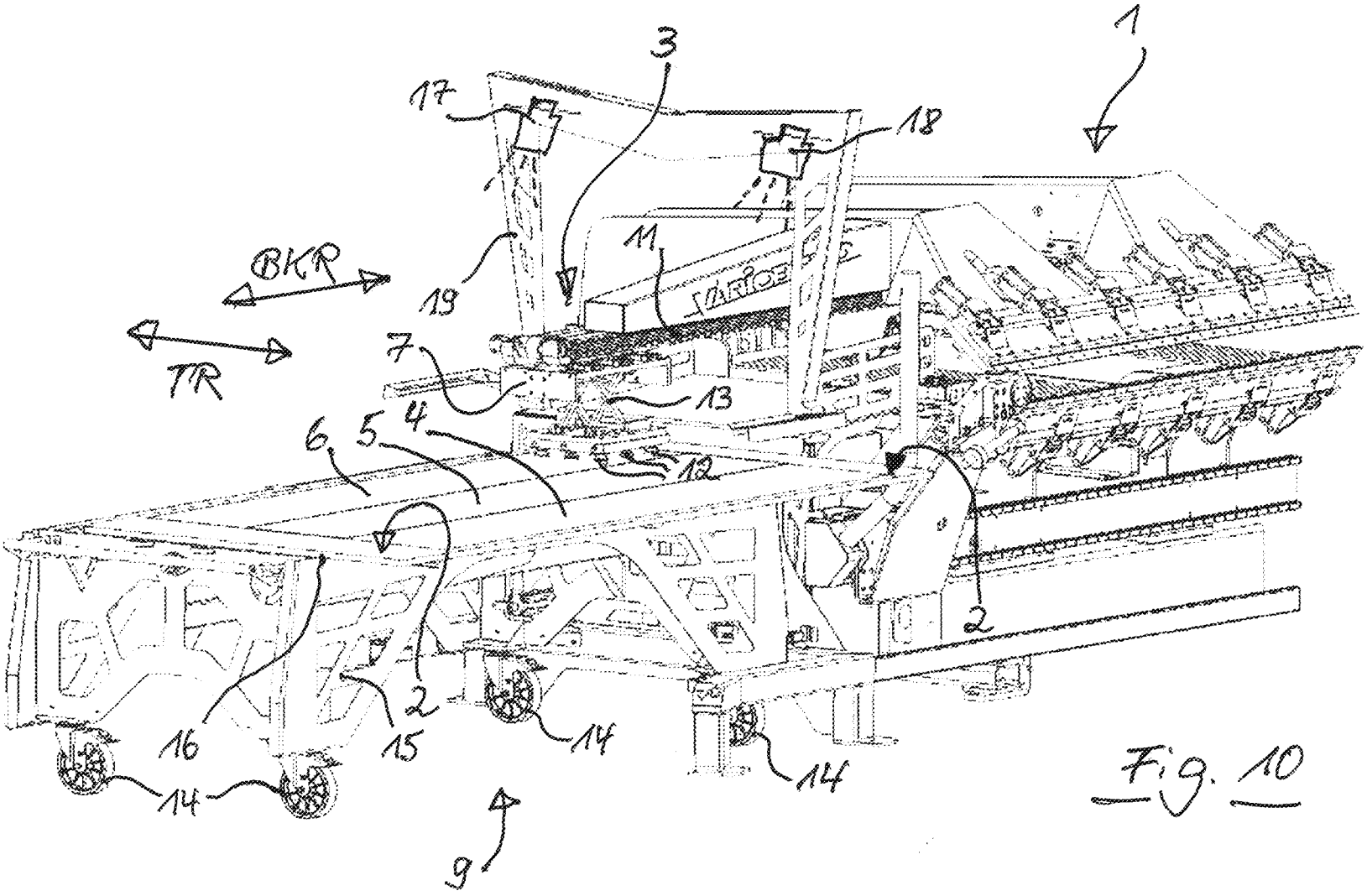
Figure 11:
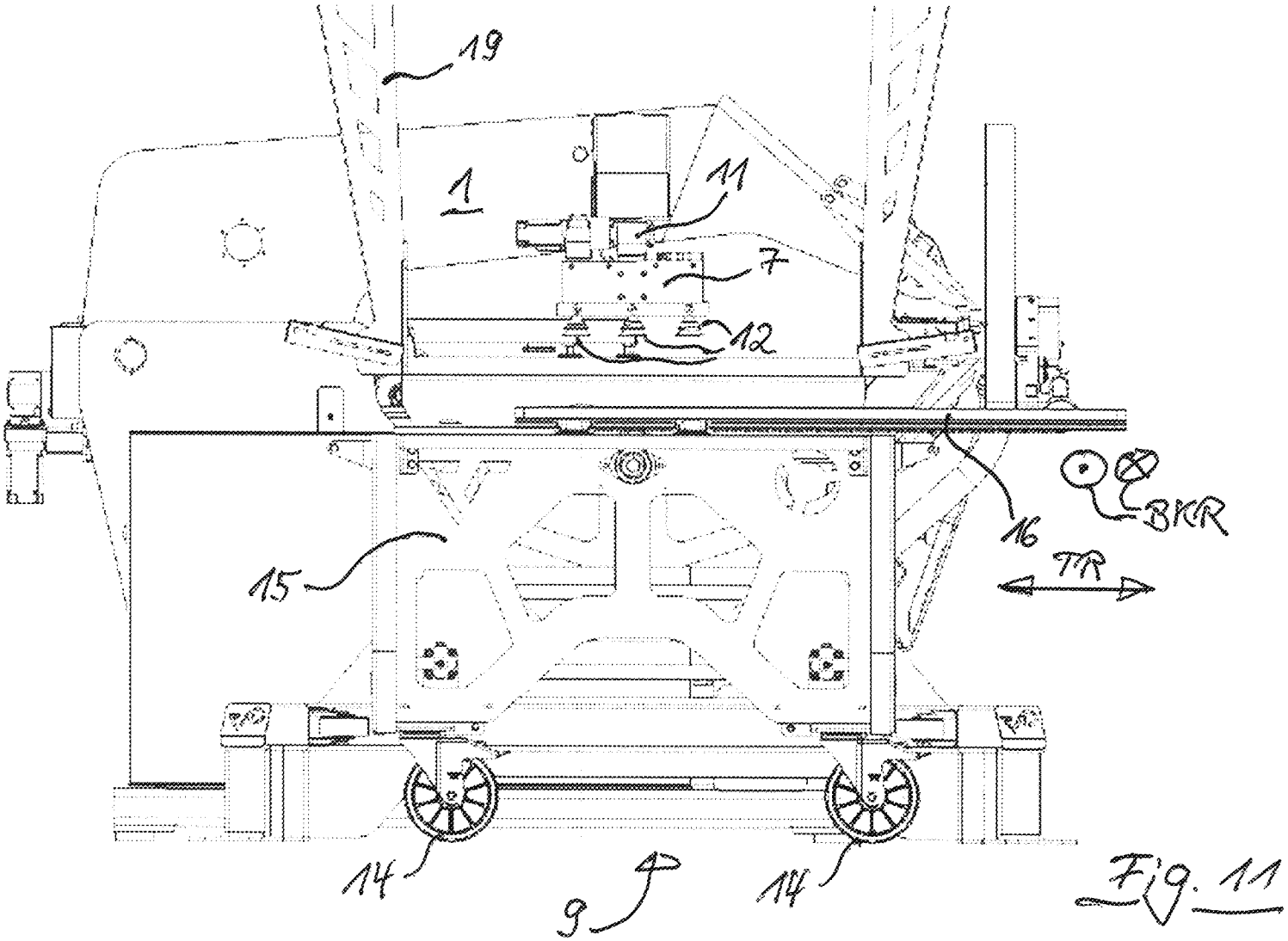
Figure 12:
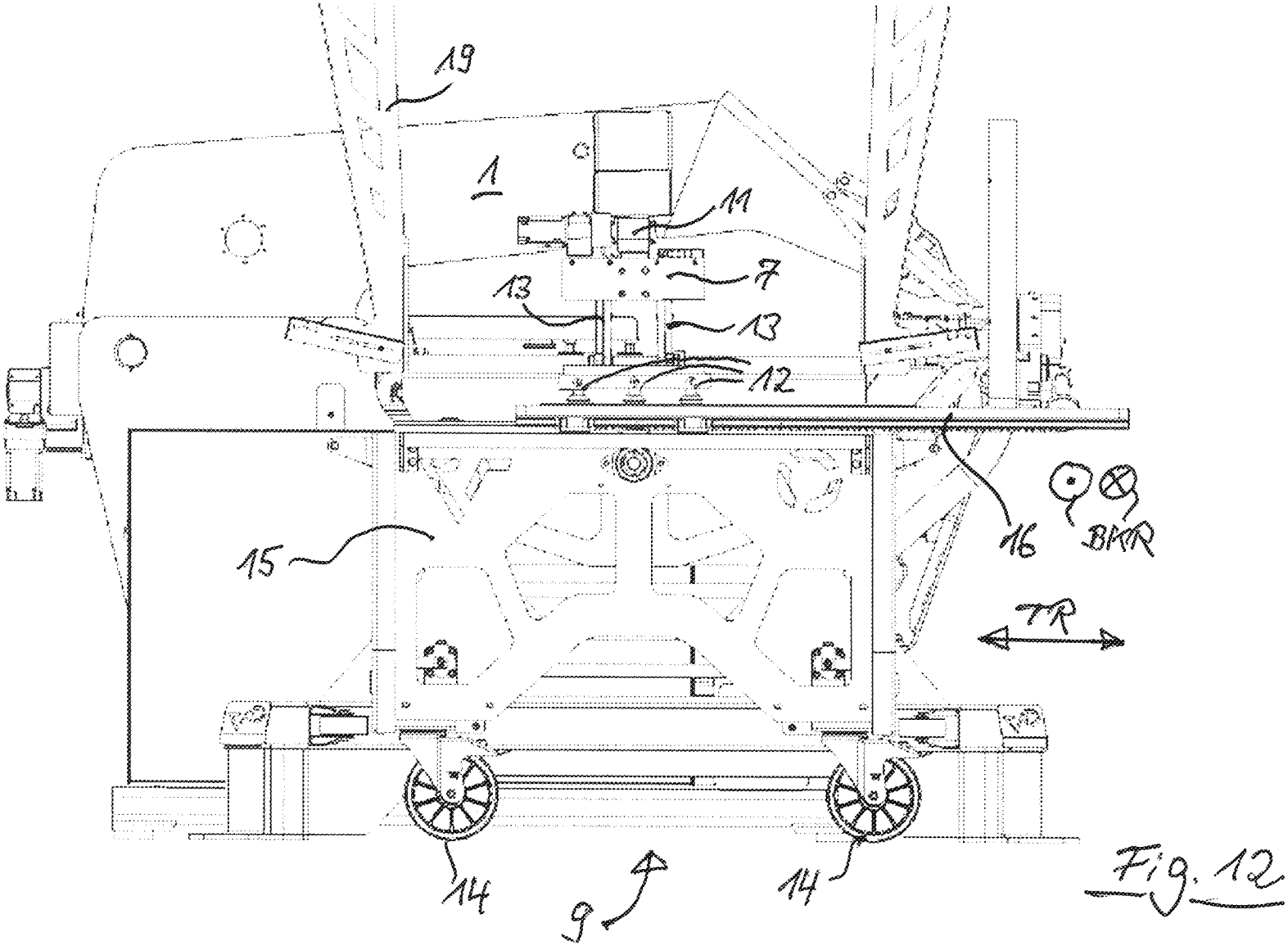

An embodiment of the present invention will be described by way of example in the following, with reference to the accompanying drawings, in which:

FIG. 1: is a perspective view of an embodiment of a combination, according to the invention, of a device for providing sheet metal pieces for drawing into a sheet metal bending machine, together with the sheet metal bending machine and a side drawing-in device, the deposition surface being located in a first position for picking up a first sheet metal piece, and the pick-up device being arranged in a position vertically spaced apart from the sheet metal piece to be picked up;

FIG. 2: is a perspective view similar to that according to FIG. 1, but the pick-up device being located in its position engaging on the sheet metal piece to be picked up;

FIG. 3: is a side view, obliquely from the front in FIG. 1, of the combination shown in FIG. 1;

FIG. 4: is a side view, obliquely from the front in FIG. 2, of the combination shown in FIG. 2;

FIG. 5: is a perspective side view of the embodiment of the combination according to the invention, the deposition surface being located at a second position for picking up a second sheet metal piece, and the pick-up device being arranged in its position vertically spaced apart from the second sheet metal piece;

FIG. 6: is a perspective view similar to FIG. 5, but the pick-up device being located in its position engaging on the second sheet metal piece;

FIG. 7: is a side view, obliquely from the front in FIG. 5, of the combination shown in FIG. 5;

FIG. 8: is a side view, obliquely from the front in FIG. 6, of the combination shown in FIG. 6;

FIG. 9: is a perspective view of the embodiment of the combination according to the invention, the deposition surface being located in a third position for picking up a third sheet metal piece, and the pick-up device being arranged in its position vertically spaced apart from the third sheet metal piece;

FIG. 10: is a perspective view similar to FIG. 9, but the pick-up device being located in its position engaging on the third sheet metal piece;

FIG. 11: is a side view, obliquely from the front in FIG. 9, of the combination shown in FIG. 9; and FIG. 12: is a side view, obliquely from the front in FIG. 10, of the combination shown in FIG. 10.

In the drawings, the same reference signs denote identical parts or elements.

As can be seen most clearly in FIGS. 1, 2, 5, 6, 9 and 10, the combination according to the invention comprises a sheet metal bending machine 1, a side drawing-in device 3 arranged thereon, and a device 9 for providing sheet metal pieces 4, 5 and 6 for drawing into the sheet metal bending machine 1 using the side drawing-in device 3. The sheet metal bending machine 1 is a long folding machine that is well-known from the prior art, of the type of the sheet metal bending machine known from EP 3 778 048 A1 for example. The fundamental type of the side drawing-in device 3 is also known to a person skilled in the art, for example from EP 3 778 048 A1.

As can be seen, the sheet metal bending machine 1 used in the context of the embodiment shown is a double bending machine known in the prior art, which comprises an upper clamping cheek, a lower clamping cheek, an upper bending cheek, and a lower bending cheek. In a likewise known manner, a work table is located inside the sheet metal bending machine 1, on which table sheet metal pieces to be bent can be placed. Within the context of the present invention, all bending machines can be used which require a sheet metal piece to be bent to be arranged on a work table. In particular it is conceivable to use a sheet metal bending machine in the form of a single bending machine instead of the sheet metal bending machine 1 shown in the figures, in the form of a double bending machine.

In addition to a pick-up device 7, the side feeding device 3 comprises a linear movement unit 11 by means of which the pick-up device 7 can be moved, in a motorised manner, into the sheet metal bending machine 1 and out of the sheet metal bending machine 1. The linear movement unit 11 can for example be formed by a belt that is mounted so as to revolve continuously and can be driven in a motorised manner and which bears the pick-up device 7.

In the embodiment shown, the pick-up device 7 is formed, in a known manner, by a suction gripper carriage comprising a plurality of suction caps 12. By means of the suction caps 12, sheet metal pieces can be raised, on account of the negative pressure that can be generated in said caps, and released again upon a signal of a machine controller. The side drawing-in device 3 is fastened to an upwardly pivotable upper part of the sheet metal bending machine 1. In the drawings, said upper part is shown in its upwardly pivoted position. The side drawing-in device 3 also performs the pivoting movements of the upper part, in a known manner.

As is most clearly visible in FIGS. 1, 2, 5, 6, 9 and 10, the suction gripper carriage 7 can be displaced by means of the linear movement unit 11, in accordance with the double arrow BKR, in parallel with the bending edge direction BKR of the sheet metal bending machine 1. The course of the straight bending edge is specified by the lower clamping cheek or the upper clamping cheek of the sheet metal bending machine 1.

In FIGS. 1, 2, 5, 6, 9 and 10 the suction gripper carriage 7 is shown in its position at the left-hand front end of the linear movement unit 11. This position corresponds to the pick-up position thereof that can be approached by it, within the meaning of the present invention. In FIGS. 1, 3, 5, 7, 9 and 11 the suction caps 12 are in their upper retracted position, in which they can draw a sheet metal piece that they are holding, in FIGS. 1, 2, 5, 6, 9 and 10, into the sheet metal bending machine 1, towards the right and to the rear. As can be seen in FIGS. 2, 4, 6, 8, 10 and 12, in the embodiment shown the suction gripper carriage 7 comprises a scissor mechanism 13, by means of which the suction caps 12 can be moved, in a motorised manner, vertically downwards into their pick-up position in which they can engage on the surface of a sheet metal piece. Actuating the scissor mechanism 13 again then makes it possible for the suction caps 12 to be moved vertically upwards, back into their retracted position, said caps raising the sheet metal piece.

In the embodiment shown, the device 9 for providing sheet metal pieces 4, 5 and 6 to be drawn into the sheet metal bending machine 1 is formed by a displaceable providing trolley 9. The providing trolley 9 comprises wheels 14 and can be displaced manually. A providing plate 16, the surface of which comprises a planar deposition surface 2 on which, in the embodiment shown, three strip-shaped sheet metal pieces 4, 5 and 6 are lying, is mounted on a base frame 15 of the providing trolley 9.

The providing plate 16, including its deposition surface 2, is movable according to the double arrow TR relative to the base frame 15 and thus relative to the sheet metal bending machine 1, as well as relative to the side drawing-in device 3 and relative to the pick-up position of the suction gripper carriage 7, in parallel with the depth direction TR of the sheet metal bending machine 1. The depth direction TR is in or in parallel with a horizontal plane that contains the bending edge of the sheet metal bending machine 1, and is located perpendicularly on the bending edge, in or in parallel with said plane.

The manner in which the mobility of the providing plate 16 relative of the base frame 15 in the depth direction TR is achieved is not important within the context of the present invention. Suitable constructions are known to a person skilled in the art in this connection. For example, the providing plate 16 could be guided in a linear guide arranged on the base frame 15. A gearwheel, which is mounted on the base frame 15 and can be driven by an electric motor, could engage in a gear rack fastened on the underside of the providing plate 16. In this way, motorized displacement of the providing plate 16 in the depth direction TR would be possible.

The providing trolley 9 can be moved towards a longitudinal and transverse dividing device, which has long been known in the prior art and is not shown in the drawings. In the longitudinal and transverse dividing device, a sheet material web wound on a coil is rolled up and cut into strip-shaped sheet metal strips 4, 5 and 6. For the purpose of the description of the embodiment, it is assumed that the sheet metal web is of such a width that it is cut into a total of three strip-shaped sheet metal pieces 4, 5 and 6, which are laid in parallel with one another and side-by-side on the deposition surface 2 of the providing plate 16, proceeding directly from the longitudinal and transverse dividing device. In the case of continued cutting operation of the longitudinal and transverse dividing device, three stacks of strip-shaped sheet metal pieces, arranged in parallel with one another and side-by-side, result on the deposition surface.

Alternatively, it is conceivable that the longitudinal and transverse dividing device may cut and lay on the deposition surface 2 sheet metal pieces of different widths from the sheet metal web, such that a plurality of stacks consisting of sheet metal pieces of the same width in each case is not provided. For example, two sheet metal pieces, lying side-by-side, of a width of 500 mm each could lie on four sheet metal pieces, lying side-by-side, of a width of 250 mm each. In turn, a single sheet metal piece of a width of e.g. 750 mm could lie on the latter. Within the context of the present invention it is also possible to provide sheet metal pieces in deposition arrangements of this kind, in which sheet metal pieces lying in different layers overlap relative to one another, in an automated manner, for drawing into the sheet metal bending machine 1.

If the desired number of sheet metal pieces has been cut from the sheet metal web and laid on the deposition surface 2, then the providing trolley 9 can be moved towards the sheet metal bending machine 1, provided with the side drawing-in device 3, without changing the deposition arrangement of the sheet metal pieces on the deposition surface 2, brought about by the longitudinal and transverse dividing device. In this case, the providing trolley 9 can be mechanically coupled to the sheet metal bending machine 1 in such a way that it assumes a predetermined, defined position relative to the pick-up position of the suction gripper carriage 7 shown in the drawings. The information relating to the relative position between the pick-up position of the suction gripper carriage 7 and a reference point, a reference line or a reference edge on the providing trolley 9 can be stored in the electronic machine controller of the sheet metal bending machine 1.

If the first sheet metal piece 4 is intended to be drawn into the sheet metal bending machine 1 for bending, then the machine controller causes the providing plate 16 to be moved, in the depth direction TR, into the first position thereof, shown in FIGS. 1 to 4. In said first position, a right-hand end region of the first sheet metal piece 4 in FIGS. 1 and 2 is located vertically under the suction gripper carriage 7. Then, by actuation of the scissor mechanism 13, the suction gripper carriage 7 is moved vertically downwards from its retracted position shown in FIGS. 1 and 3 into its pick-up position shown in FIGS. 2 and 4, until the suction caps 12 thereof rest on the above-mentioned end region of the first sheet metal piece 4.

Subsequently, the suction gripper carriage 7 is moved back upwards into its retracted position, by renewed actuation of the scissor mechanism 13. The above-mentioned end region of the first sheet metal piece 4 adheres to its suction caps 12, and the first sheet metal piece 4 can finally be drawn into the sheet metal bending machine 1 towards the right and to the rear by displacing the suction gripper carriage 7 by means of the linear movement unit 11 in FIGS. 1 and 3. In this case, the suction gripper carriage 7 draws the sheet metal piece 4 behind it and, by deactivation of the suction caps 12 in the interior of the sheet metal bending machine 1, lays said piece on the work table of said machine.

If the second sheet metal piece 5 lying on the deposition surface 2 is intended to be drawn into the sheet metal bending machine 1, then the machine controller causes the providing plate 16 to be moved, in the depth direction TR, into the second position thereof, shown in FIGS. 5 to 8. In said second position of the providing plate 16, a right-hand end region of the second sheet metal piece 5 in FIGS. 5 and 6 is located vertically above the suction gripper carriage 7. The picking up and drawing in of the second sheet metal piece 5 into the sheet metal bending machine 1 can then take place in the same way as has already been described above in connection with the first sheet metal piece 4. In order to avoid repetitions, for the sheet metal piece 5 reference is made to the above description relating to the sheet metal piece 4.

If the third sheet metal piece 6 lying on the deposition surface 2 is intended to be drawn into the sheet metal bending machine 1, then the machine controller causes the providing plate 16 to be moved, in the depth direction TR, into the third position thereof, shown in FIGS. 9 to 12. In said third position of the providing plate 16, a right-hand end region of the third sheet metal piece 6 in FIGS. 9 and 10 is located vertically above the suction gripper carriage 7. The picking up and drawing in of the third sheet metal piece 6 into the sheet metal bending machine 1 takes place in the same way as has already been described above in connection with the first sheet metal piece 4. In order to avoid repetitions, for the third sheet metal piece 6 reference is made to the above description relating to the first sheet metal piece 4.

According to the invention, the particular advantage is achieved that the three strip-shaped sheet metal pieces 4, 5 and 6 are provided in exactly the arrangement on the deposition surface 2 for drawing into the sheet metal bending machine 1 in which the longitudinal and transverse dividing device has laid the sheet metal pieces 4, 5 and 6 on the deposition surface 2. It is not necessary, as in the prior art, to stack the three sheet metal pieces 4, 5 and 6 on top of one another by hand.

The automation according to the present invention thus makes it possible for sheet metal pieces, for drawing into the sheet metal bending machine 1, to be provided in a human resource-saving and time-saving manner. In the event that a stack of a plurality of sheet metal pieces has been arranged in each case at the locations at which, in the embodiment shown, in each case a single sheet metal piece 4, 5 and 6 lies on the deposition surface 2, the sheet metal pieces are drawn in in the same way as described above. When dismantling a stack of sheet metal pieces lying at the same location of the deposition surface 2, the suction gripper carriage 7 simply moves further vertically downwards by a distance that corresponds to the sheet thickness of a sheet metal piece, as the dismantling of the stack continues, in order to pick up the next sheet metal piece of the stack in each case. In this case, a parallel dismantling of height of the stacks positioned side-by-side can take place at least if it is to be feared that the suction caps 12 can no longer grasp the uppermost sheet metal piece of a lower stack in the case of too great a height difference between the stacks for reasons of space.

It is essential to the invention that the deposition surface 2 should be displaceable in the depth direction TR relative to the pick-up position of the suction gripper carriage 7, which forms the pick-up device here. In the embodiment shown, this is achieved in that the providing plate 16 is displaceable in the depth direction TR relative to the base frame 15 of the providing trolley 9. In the embodiment, the base frame 15 of the providing trolley 9 which is coupled to the sheet metal bending machine 1 cannot be moved in the depth direction TR relative to the sheet metal bending machine 1.

Alternatively to the embodiment, it is conceivable to fasten the providing plate 16 on the base frame 15 so as to be immovable relative to said frame. The coupling of the providing trolley 9 to the sheet metal bending machine 1 could then take place such that the machine controller causes the entire providing trolley 9 to be displaced in the depth direction TR if, as described above, a particular sheet metal piece is intended to be placed vertically under the suction gripper carriage 7.

In the embodiment shown, two cameras 17 and 18 are provided, which are in wired or wireless data connection with the electronic machine controller of the sheet metal bending machine 1 and function as optical sensor devices for optically detecting the position of the sheet metal pieces 4, 5 and 6, to be drawn in, on the deposition surface 2, relative to a reference point, a reference line or a reference edge of the providing trolley 9.

In the embodiment, two cameras 17, 18 are provided, in order to be able to optically detect the deposition surface 2 in full. In the case of just one camera, the linear movement unit 11 and the suction gripper carriage 7 could hamper full optical detection of the deposition surface 2. As can be seen in FIGS. 1, 2, 5, 6, 9 and 10, the cameras 17 and 18 are attached as high as possible on an archway-like camera holder 19, in order to be able to obtain a good overview around the deposition surface 2.

The cameras 17, 18 can optically detect the position of reference edges of the sheet metal pieces 4, 5 or 6 lying on the deposition surface 2, and provide this information, via data transmission, to the electronic machine controller of the sheet metal bending machine 1.

For example, the two long edges of the sheet metal piece 4 can be optically detected as reference edges 8 and 10 (see FIG. 1).

In addition to the detection, for example, of the reference edges 8, 10, the cameras 17, 18 can optically read job identifications applied to the sheet metal pieces 4, 5 and 6 and provide these to the machine controller. The job identifications can for example be individual barcodes or QR codes printed on the surfaces of the sheet metal pieces 4, 5 and 6, which are associated with individual job data of a bending task. Such job data can in particular include the position of bending edges, the length of bending limbs, and the size of bending angles on the bent sheet metal parts to be produced. Inputting such data at a machine input device by a machine operator is thus advantageously unnecessary.

LIST OF REFERENCE SIGNS

1 Sheet metal bending machine
2 Deposition surface of the providing plate 16
3 Side drawing-in device
4 First sheet metal piece
5 First sheet metal piece
6 First sheet metal piece
7 Pick-up device of the side drawing-in device 3, Suction gripper carriage
8 Reference edge
9 Device for providing sheet metal pieces 4, 5 and 6, Providing trolley
10 Reference edge
11 Linear movement unit of the side drawing-in device 3
12 Suction cap
13 Scissor mechanism of the suction gripper carriage 7
14 Wheels of the providing trolley 9
15 Base frame of the providing trolley 9
16 Providing plate of the providing trolley 9

17 Sensor device, Camera
18 Sensor device, Camera
19 Camera holder
BKR Bending edge direction of the sheet metal bending machine 1
TR Depth direction of the sheet metal bending machine 1

The invention claimed is:

1. A method Mfor providing sheet metal pieces, which are arranged at least in part side-by-side on a planar deposition surface, for drawing into a sheet metal bending machine by a side drawing-in device which is arranged on the sheet metal bending machine, wherein the side drawing-in device comprises a pick-up device configured to move into the sheet metal bending machine and to pick-up a sheet metal piece to be drawn into the sheet metal bending machine at a predefined pick-up position above the planar deposition surface, the pick-up device being configured to approach the predefined pick-up position, wherein the method comprises the following steps:

a) detecting a position of the sheet metal piece, to be drawn into the sheet metal bending machine, on the deposition surface;

b) comparing the position detected in step a) with the predefined pick-up position; and c) moving the deposition surface, together with the sheet metal piece that is located thereon and is to be drawn in, relative to the sheet metal bending machine, such that the sheet metal piece comes to rest, at least in part, under the predefined pick-up position where it is picked up by the pick-up device, when the sheet metal piece to be drawn in is not yet located under the predefined pick-up position.

2. The method according to claim 1, wherein the detection of the position according to step a) is carried out by optical detection of reference edges of the sheet metal piece to be drawn in.

3. The method according to claim 2, wherein a job identification is applied to the sheet metal piece to be drawn in, which identification is associated with information for specifying a bending task to be carried out, the job identification being detected optically and a signal representing the job identification being transmitted to a machine controller of the sheet metal bending machine in such a way that the bending task can be carried out by the sheet metal bending machine according to the information for specifying the bending task to be carried out, after the sheet metal piece has been drawn in.

4. The method according to claim 1, wherein a job identification is applied to the sheet metal piece to be drawn in, which identification is associated with information for specifying a bending task to be carried out, the job identification being detected optically and a signal representing the job identification being transmitted to a machine controller of the sheet metal bending machine in such a way that the bending task can be carried out by the sheet metal bending machine according to the information for specifying the bending task to be carried out, after the sheet metal piece has been drawn in.

5. A combination comprising a device for providing sheet metal pieces for drawing into a sheet metal bending machine, the sheet metal bending machine and a side drawing-in device for laterally drawing a sheet metal piece into the sheet metal bending machine, wherein the side drawing-in device being arranged on the sheet metal bending machine, wherein the device for providing the sheet metal pieces is configured to be coupled to the sheet metal bending machine and comprises a planar deposition surface being configured to provide the sheet metal pieces lying side-by-side at least in part, and wherein the side drawing-in device comprises a pick-up device being configured to move into the sheet metal bending machine and to pick-up a sheet metal piece to be drawn into the sheet metal bending machine at a predefined pick-up position above the deposition surface, the pick-up device being configured to approach the predefined pick-up position, wherein the combination comprises:

a motor drive device configured to move the deposition surface relative to the sheet metal bending machine when the device for providing sheet metal pieces is coupled to the sheet metal bending machine;

a sensor device for detecting a position of the sheet metal piece, to be drawn into the sheet metal bending machine, on the deposition surface;

a comparator device for comparing the position detected by the sensor device with the predefined pick-up position; and a machine controller configured to cause the motor drive device to move the deposition surface, together with the sheet metal piece that is located thereon and is to be drawn in, relative to the sheet metal bending machine when the device for providing sheet metal pieces is coupled to the sheet metal bending machine, such that the sheet metal piece comes to rest, at least in part, under the predefined pick-up position where it is picked up by the pick-up device, if the comparator device has determined that the sheet metal piece to be drawn in is not yet located under the predefined pick-up position.

6. The combination according to claim 5, wherein the device for providing sheet metal pieces is a movable providing trolley which comprises the motor drive device, a base frame and a providing plate which comprises the planar deposition surface, the providing plate being movably mounted on the base frame and being drivable by of the motor drive device.

7. The combination according to claim 5, wherein the sensor device is an optical sensor device for optical detection of reference edges of the sheet metal piece to be drawn in.

8. The combination according to claim 7, wherein the optical sensor device is formed by at least one camera.

9. The combination according to claim 5, wherein a job identification applied to the sheet metal piece to be drawn in can be detected by the sensor device, which identification is associated with information for specifying a bending task to be carried out, and the machine controller is designed such that, after receiving a signal representing the job identification, it causes the sheet metal bending machine to carry out the bending task, after the sheet metal piece has been drawn in, according to the information for specifying the bending task to be carried out.

10. The combination according to claim 6, wherein the sensor device is an optical sensor device for optical detection of reference edges of the sheet metal piece to be drawn in.

11. The combination according to claim 10, wherein the optical sensor device is formed by at least one camera.

12. The combination according to claim 6, wherein a job identification applied to the sheet metal piece to be drawn in can be detected by the sensor device, which identification is associated with information for specifying a bending task to be carried out, and the machine controller is designed such that, after receiving a signal representing the job identification, it causes the sheet metal bending machine to carry out the bending task, after the sheet metal piece has been drawn in, according to the information for specifying the bending task to be carried out.

13. The combination according to claim 7, wherein a job identification applied to the sheet metal piece to be drawn in can be detected by the sensor device, which identification is associated with information for specifying a bending task to be carried out, and the machine controller is designed such that, after receiving a signal representing the job identification, it causes the sheet metal bending machine to carry out the bending task, after the sheet metal piece has been drawn in, according to the information for specifying the bending task to be carried out.

14. The combination according to claim 8, wherein a job identification applied to the sheet metal piece to be drawn in can be detected by the sensor device, which identification is associated with information for specifying a bending task to be carried out, and the machine controller is designed such that, after receiving a signal representing the job identification, it causes the sheet metal bending machine to carry out the bending task, after the sheet metal piece has been drawn in, according to the information for specifying the bending task to be carried out.

15. The combination according to claim 10, wherein a job identification applied to the sheet metal piece to be drawn in can be detected by the sensor device, which identification is associated with information for specifying a bending task to be carried out, and the machine controller is designed such that, after receiving a signal representing the job identification, it causes the sheet metal bending machine to carry out the bending task, after the sheet metal piece has been drawn in, according to the information for specifying the bending task to be carried out.

16. The combination according to claim 11, wherein a job identification applied to the sheet metal piece to be drawn in can be detected by the sensor device, which identification is associated with information for specifying a bending task to be carried out, and the machine controller is designed such that, after receiving a signal representing the job identification, it causes the sheet metal bending machine to carry out the bending task, after the sheet metal piece has been drawn in, according to the information for specifying the bending task to be carried out.

* * * * *